United States Patent [19]

Kawase et al.

[11] Patent Number: 4,877,931

[45] Date of Patent: Oct. 31, 1989

[54] SWITCH HAVING A VISABLE INDICATOR

[75] Inventors: Toshihiro Kawase, Aichi; Sachiya Sano, Gifu, both of Japan

[73] Assignee: Kabushiki Kaisha Tokai Rika Denki Seisakusho, Aichi, Japan

[21] Appl. No.: 228,653

[22] Filed: Aug. 5, 1988

[30] Foreign Application Priority Data

Aug. 12, 1987 [JP] Japan ..... 62-123579[U]

[51] Int. Cl.[4] ..... H01H 9/16

[52] U.S. Cl. ..... 200/308; 200/524; 116/285

[58] Field of Search ..... 200/308, 310, 312, 523, 200/524, 318.1, 341, 342, 345, 314; 116/279, 284, 285, 294, 299, 309, 311, 312

[56] References Cited

U.S. PATENT DOCUMENTS

| | | | |
|---|---|---|---|
| 3,855,959 | 12/1974 | Hinze | 200/308 X |
| 3,855,961 | 12/1974 | Schadow | 200/308 X |
| 4,023,003 | 5/1977 | Arthur et al. | 200/308 |
| 4,025,954 | 5/1977 | Roy | 116/285 |
| 4,044,213 | 8/1977 | Kinney | 200/308 |
| 4,129,766 | 12/1978 | Miyata et al. | 200/308 |
| 4,223,193 | 9/1980 | Iwasaki et al. | 200/308 |
| 4,287,401 | 9/1981 | Rohrbach | 200/308 |
| 4,354,076 | 10/1982 | Lutzenberger | 200/308 |

FOREIGN PATENT DOCUMENTS

| | | | |
|---|---|---|---|
| 1169549 | 5/1964 | Fed. Rep. of Germany | 200/524 |
| 1435222 | 5/1976 | United Kingdom | 200/524 |

*Primary Examiner*—Ernest G. Cusick

*Attorney, Agent, or Firm*—Finnegan, Henderson, Farabow, Garrett & Dunner

[57] ABSTRACT

A switch mechanism for visually indicating whether the switch is turned on or off includes a button having a hole and being depressable to turn the switch on or off. A rotatable indicator includes a first color portion that is positioned in the opening when the switch is turned on and a second color portion that is positioned in the opening when the switch is turned off. An indicator controller is coupled to the button and the indicator and carries the contacts for the switch. The indicating controller moves the indicator to position the proper colored portion in the opening in response to the opening and closing of the switch contacts by the depression of the button.

2 Claims, 3 Drawing Sheets

SWITCH HAVING A VISABLE INDICATOR

BACKGROUND OF THE INVENTION

1. Field of the Invention

The present invention relates to a switch whose turned-on and turned-off states are indicated.

2. Description of the Related Art

The turned-on or turned-off state of a conventional switch for a motor vehicle or the like is commonly indicated by a lamp which is provided at the casing of the switch and is turned on and off by manipulation of a button that controls the switch. In bright sunlight, however, the brightness of the indication lamp is often not high enough to permit the easy visual recognition that the switch is turned on or off.

SUMMARY OF THE INVENTION

An object of the present invention is to provide a switch that visually indicates whether it is on or off.

Another object of the present invention is a switch whose turned-on or turned-off state can be easily visually recognized even in bright sunlight.

These and other objects are accomplished by a switch comprising a depressable button having an opening, a contact holder moved from a turned-off position to a turned-on position or from the turned-on position to the turned-off position in response to the depression of the button and retained in the turned-on or turned-off position until a subsequent depression of the button, an indicator having a turned-on state indicating portion and a turned-off state indicating portion on the outside surface of the indicator and being rotatable to position in the opening of the button either the turned-on state indicating portion or the turned-off state indicating portion such that the positioned indicating portion is visible through the opening of the button, and an indication controller being movable between an upper position and a lower position in response to the depression of the button and engaging the indicator for rotating the indicator in response to the depression of the button to rotate the indicator to position one of the turned-off state indicating portion and the turned-on state indicating portion in the opening of the button in response to movement of the indicator controller to the upper position and to position the other of the turned-off state indicating portion and the turned-on state indicating portion in the opening in response to movement of the indicator controller to the lower position.

BRIEF DESCRIPTION OF THE DRAWINGS

The manner by which the above objects and other objects features, and advantages of the present invention are obtained will be fully apparent from the following detailed description when it is considered in view of the drawings, wherein.

DETAILED DESCRIPTION OF THE PREFERRED EMBODIMENT

The switch of the present invention includes a button that has an opening in a prescribed portion and can be pushed into the casing of the switch. A contact holder is moved from a turned-off position to a turned-on position, or from a turned-on position to a turned-off position in conjunction with the pushing of the button, and is retained in either the turned-on or turned-off position until a subsequent pushing of the button. In this manner, a switching contact assembly is electrically connected or disconnected, and an indicator is rotated to position in the opening either a turned-on state indicating portion or a turned-off state indicating portion. An indication controller is movable in conjunction with the contact holder so that the indication controller engages the indicator in a rotated position in conjunction with the movement of the contact holder to the turned-off position to make the turned-off state indicating portion visible through the opening, and engages the indicator in another rotated position in conjunction with the movement of the contact holder to the turned-on position to move the turned-on state indicating portion into the opening of the button.

When the contact holder is in the turned-off position so that the switching contact assembly is electrically disconnected, the indicator is engaged in the rotated position by the indication controller so that the turned-off state indicating portion of the indicator is visible through the opening of the button. The turned-off state of the switch can be easily visually recognized through the opening of the button. When the contact holder is moved to the turned-on position by the subsequent pushing of the button so that the switching contact assembly is electrically connected, the indicator is engaged in another rotated position by the indication controller so that the turned-on state indicating portion of the indicator becomes visible.

Since the turned-on state indicating portion and turned-off state indicating portion of the indicator are made visible through the opening of the button in accordance with the electrical connection or disconnection of the switching contact assembly without using a lamp, the visibility of the indication of both the turned-on state and the turned-off state in bright sunlight is greatly improved.

Figure 1:
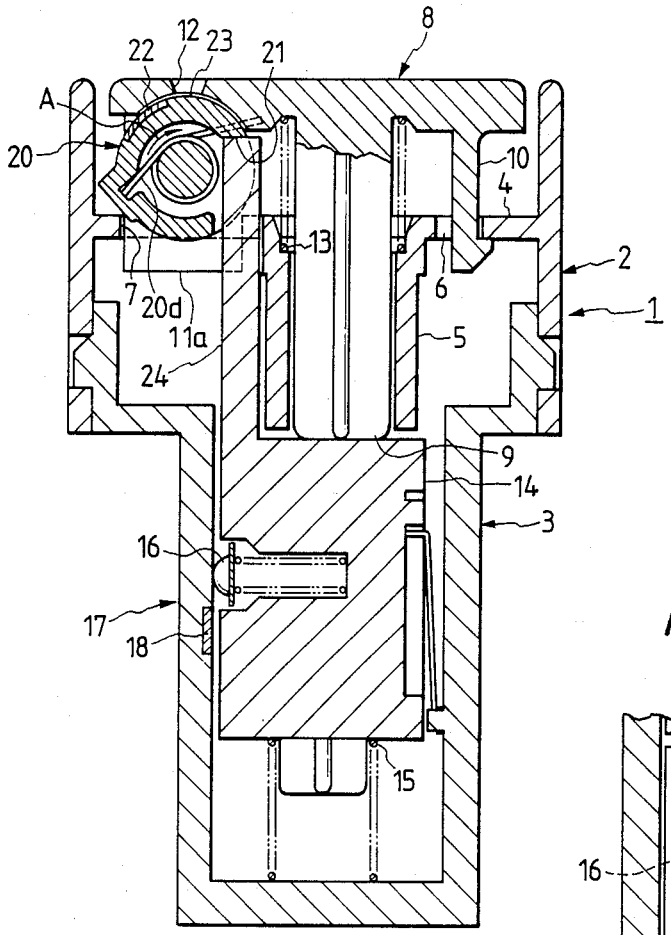
FIG. 1 shows a longitudinal sectional view of a switch according to the present invention.

FIG. 1 shows a longitudinal sectional view of the switch of the present invention which includes a casing 1 having an upper section 2 and a lower section 3. The upper section 2 has a horizontal plate 4 fitted with a cylindrical guide 5 for a button 8 and is provided with an opening 7 and a hole 6. A pusher 9 is provided on the bottom of the button 8.

Figure 2:
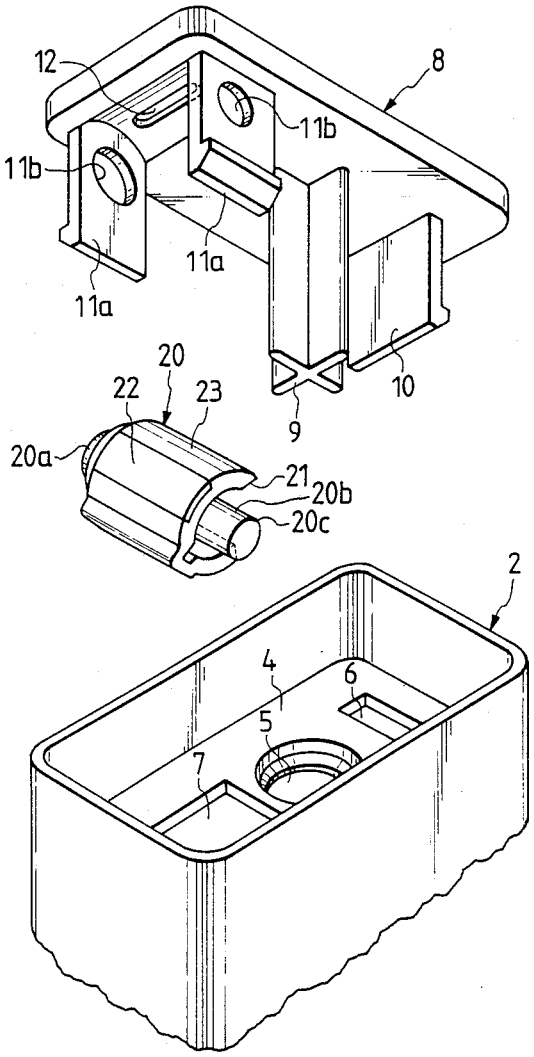
FIG. 2 shows an exploded perspective view of a major part of the switch of FIG. 1.

As shown in FIG. 2, a guide 10 and a pair of guides 11*a* are also provided on the bottom of the button 8 to prevent the button from falling out from the switch. The guides 11*a* have fitting holes 11*b*. An opening 12 is provided in the button 8 between the guides 11*a*. The pusher 9 is inserted into the guide 5. The guide 10 is inserted into the hole 6. The guides 11*a* are inserted into the opening 7. In this manner, the button 8 is fitted in the upper section 2 of the casing 1 so that the button can be moved up and down. The button 8 is urged upward by a spring 13 shown in FIG. 1 so that the button is normally located in an upper limit position.

As shown in FIG. 1, a contact holder 14 is disposed in the casing 1 under the pusher 9 of the button 8 so that the contact holder 14 can be moved up and down. The contact holder 14 is urged upward by a spring 15. A movable contact 16 is provided in the contact holder 14. A pair of fixed contacts 18 are provided, adjacent to, but separated from, one another, on the inside surface of the lower section 3 of the casing 1. The movable contact 16 and the fixed contacts 18 constitute a switching contact assembly 17.

When the contact holder 14 is in an upper limit position, the fixed contacts 18 are not connected to each other through the movable contact 16, so that the switching contact assembly 17 is electrically disconnected. When the contact holder 14 is moved downwardly by the pushing of the button 8, the fixed contacts 18 are connected to each other through the movable contact 16 so that the switching contact assembly 17 is electrically connected. The contact holder 14 remains engaged in the lower limit position by a heart-shaped cam mechanism 19 shown in FIG. 3, so that the switching contact assembly 17 remains electrically connected until the subsequent pushing of the button 8. When the button 8 is pushed again, the contact holder 14 is disengaged from the heart-shaped cam mechanism 19 so that the switching contact assembly 17 is electrically disconnected.

Figure 4:
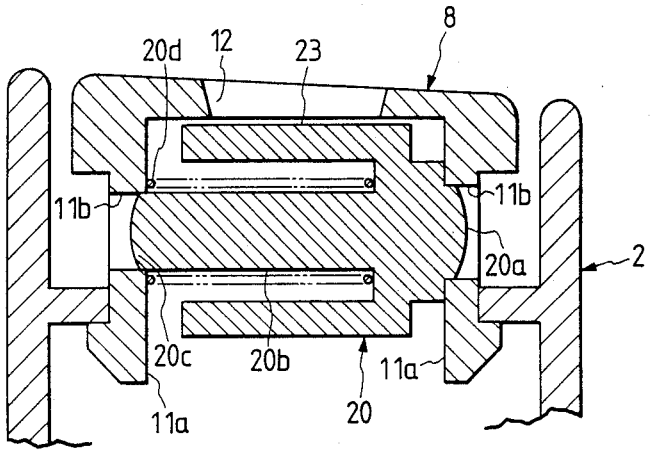
FIG. 4 shows a longitudinal sectional view of the indicator of the switch of FIG. 1.

As shown in FIG. 1, an indicator 20 is shaped nearly as a cylinder closed at one end thereof, and is disposed in the upper section 2 of the casing 1. As shown in FIGS. 2 and 4, the indicator 20 is provided with a support portion 20*a* at one end and another support portion 20*c* at the other end. The support 20*c* is constituted by the tip of a rod 20*b* of the indicator 20. The peripheral portion of the indicator 20 has an opening that extends in parallel with the axis of the indicator. The indicator 20 has an engaged portion 21 at the top of the opening.

Figure 5:
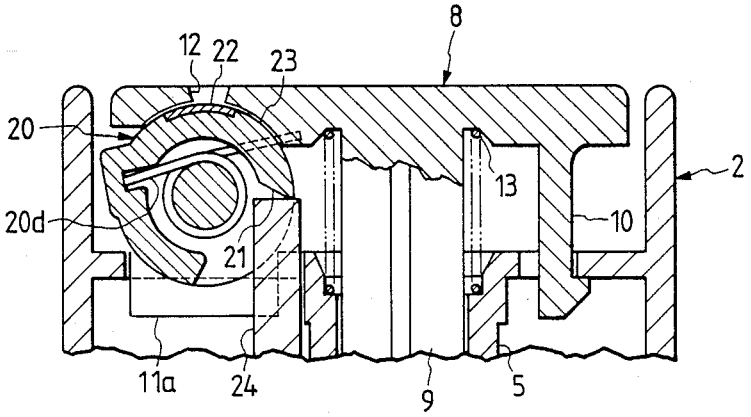
FIG. 5 shows a longitudinal sectional view of a part of the switch of FIG. 1 which includes the indicator.

A turned-on state indicating portion 22 is provided on the outside surface of the indicator 20 and has a color different from that of the other portions of the indicator 20. A turned-off state indicating portion 23 is also provided on the outside surface of the indicator 20 next to the turned-on state indicating portion 22 in a clockwise direction therefrom as shown by arrow A in FIG. 1. The support portions 20*a* and 20*c* of the indicator 20 are fitted in the fitting holes 11*b* of the guides 11*a* of the button 8 so that the indicator can be rotated relative to the button 8. As shown in FIG. 5, the indicator 20 is urged by a coiled torsional spring 20*d* so as to be rotated in a clockwise direction shown by arrow A in FIG. 1. When the indicator 20 is rotated, either the turned-on state indicating portion 22 or the turned-off state indicating portion 23 becomes visible through the opening 12 of the button 8.

Figure 3:
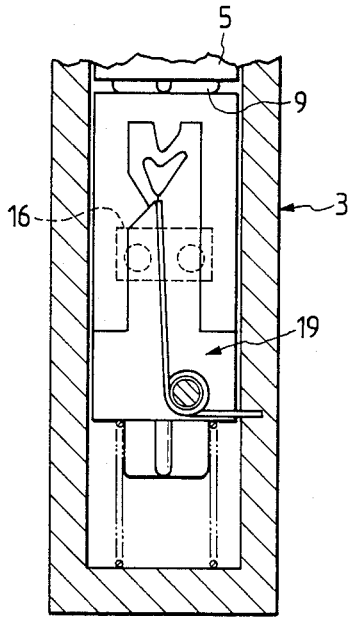
FIG. 3 shows a longitudinal sectional view of a part of the switch of FIG. 1 showing a switching contact assembly and a heart-shaped cam mechanism of the switch.

As shown in FIG. 1, an indication controller 24 is integrally formed on the contact holder 14 so that the indication controller 24 extends toward the engaged portion 21 of the indicator 20. When the contact holder 14 is in an upper limit position so that the switching contact assembly 17 is electrically disconnected, the indication controller 24 engages the engaged portion 21 of the indicator 20 as shown in FIG. 1. At that time, the indicator 20 is in the position such that the turned-off state indicating portion 23 becomes visible through the opening 12 of the button 8, and be easily visually recognized by eyesight the turned-off state of the switch. When the button 8 is subsequently pushed, the contact holder 14 is moved down so that the switching contact assembly 17 is electrically connected and the contact holder 14 is engaged in the lower limit position by the heart-shaped cam mechanism 19 as shown in FIG. 3. The contact holder 14 remains engaged in the lower limit position when the button 8 is released and returned upwardly to the original upper position. The indication controller 24 is moved downwardly in conjunction with the contact holder 14. The indicator 20 is rotated in a clockwise direction indicated by the arrow A as shown in FIG. 1 in response to the downward movement of the contact holder 14 so that the turned-on state indicating portion 22 of the indicator 20 becomes visible through the opening 12 of the button 8, and may be easily visually recognized.

What is claimed is:

1. A switch comprising:

a depressable button having an opening;

a contact holder moved from a turned-off position to a turned-on position or from the turned-on position to the turned-off position in response to the depression of said button and retained in said turned-on or turned-off position until a subsequent depression of said button;

an indicator having a turned-on state indicating portion and a turned-off state indicating portion on the outside surface of said indicator and being rotatable to position in the opening of said button either said turned-on state indicating portion or said turned-off state indicating portion such that said positioned indicating portion of said indicator is visible through said opening of said button, said indicator including a rotatable member and said turned-on state indicating portion including a first surface portion of said member signifying said turned-on state of the switch and said turned-off state indicating portion including a second surface portion of said member signifying said turned-off state of the switch;

a spring for rotating said rotatable member to position said turned-on state indicating portion or said turned-off state indicating portion in said opening of said button; and an indication controller movable between an upper position and a lower position in response to the depression of said button and engaging said indicator for rotating said indicator in response to the depression of said button to rotate said indicator to position one of said turned-off state indicating portion and said turned-on state indicating portion in the opening of said button in reponse to movement of said indication controller to said upper position and to position the other of said turned-off state indicating portion and said turned-on state indicating portion into the opening in response to movement of said indication controller to said lower position, said indication controller including an elongated member formed on said contact holder and having an end for engaging said rotatable member to rotate said rotatable member against the force of said spring to position one of said turned-off state indicating portion and turned-on state indicating portion in said opening of said button in response to movement of said indicating controller to said upper position.

2. A switch according to claim 1, further including a cam mechanism for engaging said indicating controller to maintain said indicating controller in said upper position until the subsequent depression of said button.

* * * * *